US012716305B1

(12) United States Patent
Almasmoom et al.

(10) Patent No.: US 12,716,305 B1
(45) Date of Patent: Aug. 25, 2026

(54) LONG STRING WORKOVER OPERATIONS COMPLETIONS TOOL WITH AN ANNULAR RELEASE MECHANISM

(71) Applicant: SAUDI ARABIAN OIL COMPANY, Dhahran (SA)

(72) Inventors: Salahaldeen Saleh Almasmoom, Dhahran (SA); Majed Nasser Alrawdhan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/358,304

(22) Filed: Oct. 14, 2025

(51) Int. Cl.
*E21B 23/01* (2006.01)
*E21B 33/14* (2006.01)

(52) U.S. Cl.
CPC ..... *E21B 23/01* (2013.01); *E21B 33/14* (2013.01)

(58) Field of Classification Search
CPC ..... E21B 23/01; E21B 33/14
See application file for complete search history.

(56) References Cited

U.S. PATENT DOCUMENTS 4,311,195 A * 1/1982 Mullins, II ..... E21B 33/1295 166/182
4,333,530 A * 6/1982 Armstrong ..... E21B 34/12 166/291
4,479,544 A * 10/1984 Callihan ..... E21B 33/1295 166/290
4,501,330 A * 2/1985 Garcia ..... E21B 17/06 166/285
5,370,186 A * 12/1994 Ireland ..... E21B 23/0411 166/212
6,223,824 B1 * 5/2001 Moyes ..... E21B 23/00 251/63.4
10,082,003 B2 9/2018 Sheehan et al.
2013/0269948 A1 * 10/2013 Hoffman ..... E21B 43/11 166/351
2014/0305662 A1 * 10/2014 Giroux ..... E21B 33/13 166/65.1

(Continued)

FOREIGN PATENT DOCUMENTS

AU 2012392160 B2 6/2016
CA 2711877 C 7/2017
WO 2020153864 A1 7/2020

*Primary Examiner* — Shane Bomar
(74) *Attorney, Agent, or Firm* — Osha Bergman Watanabe & Burton LLP

(57) ABSTRACT

A completion string includes a first casing string including a bell end, a second casing string received within the bell end, and an anchor latch mechanism having a first latch portion and a second latch portion. The insertion of the second casing string into the bell end engages the second latch portion with the first latch portion to connect the first casing string to the second casing string. A shear pin retains the anchor latch mechanism. An annular release mechanism in the second casing string includes an atmospheric chamber disposed radially within the second casing string and a piston sleeve defining a portion of the atmospheric chamber. The piston sleeve is axially shiftable upon application of external annular pressure against the atmospheric chamber shearing a shearable connection, such that the piston sleeve axially shifts to disengage the anchor latch mechanism.

15 Claims, 6 Drawing Sheets

(56) References Cited

U.S. PATENT DOCUMENTS

| | | | | |
|---|---|---|---|---|
| 2015/0176367 | A1* | 6/2015 | Hern | E21B 34/142<br>166/285 |
| 2021/0310338 | A1* | 10/2021 | Turley | E21B 23/042 |
| 2021/0348463 | A1* | 11/2021 | Godfrey | E21B 23/14 |
| 2025/0163763 | A1* | 5/2025 | Almasmoom | E21B 17/08 |

* cited by examiner

LONG STRING WORKOVER OPERATIONS COMPLETIONS TOOL WITH AN ANNULAR RELEASE MECHANISM

BACKGROUND

In oil and gas well completions, long casing strings are commonly used to provide structural integrity and zonal isolation. These long strings often incorporate multiple tools, such as packers, to support production and intervention operations. However, operations involving long strings can present challenges, particularly when the upper portion of the casing needs to be removed for maintenance, replacement, or tool retrieval. Eventually, a workover of a non-cemented section of the casing or the upper casing that is corroded needs to be performed.

Conventional methods of accessing the upper section of casing typically requires cutting the casing to pull the casing, which is time-consuming, costly, and can compromise well integrity. The upper portion of the casing string is often subjected to high-pressure and high-temperature (HPHT) loads, making removal even more difficult. Additionally, completions must allow for future workovers, meaning any removal tool must be compatible with repeated interventions. Accordingly, there exists a need for a specialized tool that can selectively disengage and release the upper portion of a long casing string, withstand HPHT conditions, and allow for controlled removal and future workovers without cutting the string or compromising downhole completion.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a completion string for a wellbore comprising: a first casing string comprising a bell end; a second casing string configured to be received within the bell end of the first casing string; an anchor latch mechanism comprising a first latch portion fixed to the first casing string and a second latch portion fixed to the second casing string, wherein insertion of the second casing string into the bell end engages the second latch portion with the first latch portion to connect the first casing string to the second casing string; a shear pin pinned in the anchor latch mechanism that retains the anchor latch mechanism in an engaged position, wherein the shear pin is breakable upon application of a predetermined axial force; and an annular release mechanism disposed in the second casing string comprising an atmospheric chamber disposed radially within the second casing string and a piston sleeve defining at least a portion of the atmospheric chamber, wherein the piston sleeve is axially shiftable upon application of external annular pressure against the atmospheric chamber shearing the shearable connection, such that the piston sleeve axially shifts to disengage the anchor latch mechanism.

In one aspect, embodiments disclosed herein relate to a method for disconnecting a first casing string from a second casing string in a wellbore, the method comprising: running the second casing string into a bell end of the first casing string; engaging a second anchor latch portion on the second casing string with a first anchor latch portion of the first casing string to secure the second casing string to the first casing string; retaining the second anchor latch portion in engagement with the first anchor latch portion using a shear pin; applying annular pressure to an annular release mechanism disposed in the second casing string, the annular release mechanism comprising a piston sleeve and an atmospheric chamber, wherein the annular pressure is communicated externally to act on the piston sleeve against the atmospheric chamber; axially shifting the piston sleeve under applied annular pressure to shear a shearable connection retaining the piston sleeve to the second anchor latch portion; shearing the shear pin by applying axial force upon the second casing string to release the second anchor latch portion from the first anchor latch portion; disengaging the second anchor latch portion from the first anchor latch portion by axially shifting the piston sleeve; upon shearing the shear pin, releasing the second anchor latch portion from the first anchor latch portion; and upon disengagement and releasing of the second anchor latch portion from the first anchor latch portion, withdrawing the second casing string from the wellbore while leaving the first casing string in the wellbore.

Other aspects and advantages of the claimed subject matter will be apparent from the following description and the appended claims.

DETAILED DESCRIPTION

Figure 1:
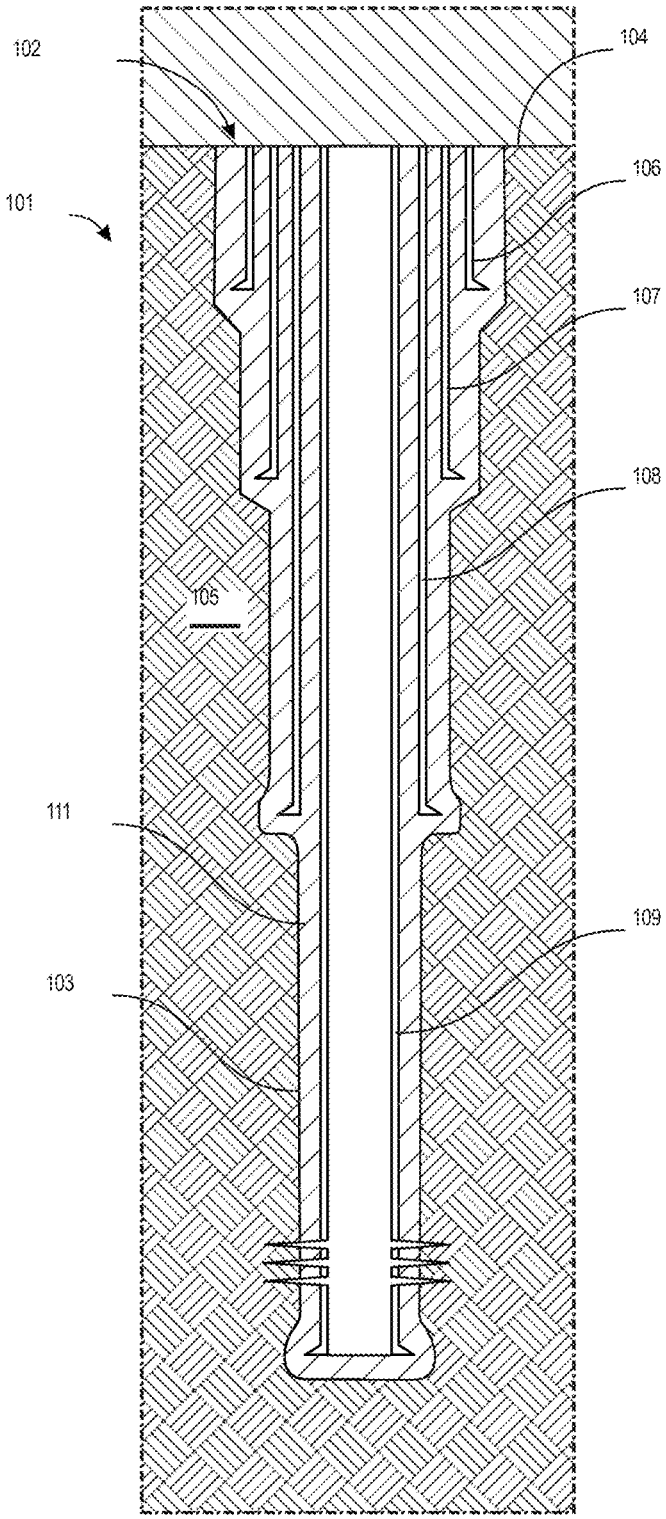
FIG. 1 shows a well system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a long string casing completion string for a wellbore including an upper portion connected to and within a lower portion of the casing capable of connecting and disconnecting for replacement. The completion string includes an anchor latch mechanism for connecting and disconnecting the upper portion to the lower portion and a shear pin for retention. The completion string further includes an annular release mechanism to disengage the anchor latch mechanism. The completion string is designed to be run in as part of long string cemented completions and to sustain cementing operations, to be stimulated, and to produce through the tool. Disconnecting of the upper portion allows for replacement of a corroded or damaged part of completion by reconnecting a new completion string.

Embodiments of the present disclosure may provide at least one of the following advantages. Advantages include withstanding HPHT loads and capability of future workovers. The completion string is run as part of an initial cemented long string completion and provides a safe way to disconnect the upper section of the cemented long string completion for replacement by workover. An annular release polished bore receptacle (PBR) mechanism in the completion string allows for safe and efficient disconnection and re-connection of the completion string. Advantages further include handling heavy loads during different stages and fluids stimulation treatments, such as hydraulic fracturing (up to 70 stages sometimes with applied surface pressure of 10,000-15,000 psi). The completion string may be placed in the wellbore strategically, such that the connection of the upper and lower string is uphole from a depth of solids settling and accumulation from drilling fluid.

A completed well (101), as illustrated in FIG. 1, includes a casing profile (102) within a wellbore (103) extending from a surface (104) into subterranean formations (105). In general, there may be many layers of subterranean formations (105) below the surface (104). The casing profile (102) includes multiple casing strings, such as a conductor casing (106), a surface casing (107), an intermediate casing (108), and a production casing (109). The conductor casing (106) may be a large-diameter casing that protects shallow formations from contamination by drilling fluid and helps prevent washouts involving unconsolidated topsoils and sediments. The surface casing (107), the second string, has a smaller diameter than the conductor casing (106), maintains borehole integrity and prevents contamination of shallow groundwater by hydrocarbons, subterranean brines and drilling fluids. The intermediate casing (108), the third string, has a smaller diameter than the surface casing (107), isolates hydrocarbon-bearing, abnormally pressured, fractured and lost circulation zones, providing well control as engineers drill deeper. Multiple strings of the intermediate casing (108) may be required to reach the target producing zone. The production casing (109), or liner, is the last and smallest tubular element in the completed well (101). The production casing (109) isolates the zones above and within the production zone and withstands all of the anticipated loads throughout the well's life. Additionally, the production casing (109) may be perforated to allow hydrocarbons to flow into the production casing (109).

Furthermore, each casing string (106-109) undergoes a cement operation. Typically, a well section is drilled; then a casing string (e.g., the conductor casing (106), the surface casing (107), the intermediate casing (108), or the production casing (109)) is lowered into the wellbore (103) and then cemented. In a cement operation, a slurry (111) of cement, cement additives and water is pumped into the wellbore (103) down through the casing string (106-109) and into an annulus around the casing string (106-109) or in the open hole below the casing string (106-109). In some cases, the cement slurry (111) is introduced into the annulus without pumping the cement slurry (111) around the bottom end of the casing string (106-109). To achieve this, a stage cementing tool, herein after also referred to as "mechanical stage collars" or "differential valve tools," installed at various depths along the casing string (106-109), may be used to introduce the cement slurry (111) directly into the annulus along a length of the casing string (106-109). Cement slurry (111) supports and protects well casings and helps achieve zonal isolation while protecting the surrounding environment.

Figure 2:
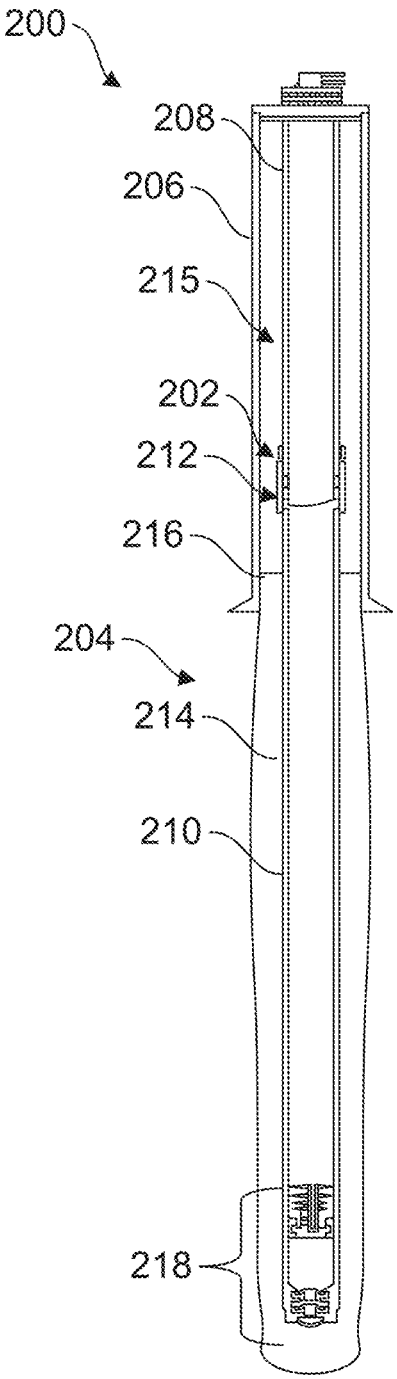
FIG. 2 shows a long string system in accordance with one or more embodiments.

FIG. 2 shows a long string system in accordance with one or more embodiments. Specifically, FIG. 2 shows a long string system (200) incorporating a completion string (202) as run into a wellbore (204). The long string system (200) of FIG. 2 may be used in conjunction with the completed well (101) of FIG. 1 to replace casing string (109). As illustrated in FIG. 2, the long string system (200) may include a wellbore (204) drilled and lined with a surface casing (206) (e.g., casing (106)). FIG. 2 shows the completion string (202) including an upper string (208) and lower string (210) is run into the wellbore (204). The upper string (208) is received within a bell end (212) of the lower string (210) for connection. Either of upper string (208) and lower string (210) may be considered a "first" string and the other may be considered a "second" string. The bell end (212) of the lower string (210) may be a flared or enlarged end designed to receive a plain or spigot end of another pipe (i.e., upper string (208)) to create a bell-and-spigot joint. The bell end (212) may act as a socket, while the upper string (208) is inserted. The bell end (212) may aid in alignment and joint connection without the use of external couplings. In such instances, the upper string (208) is smaller in diameter to the bell end (212) of the lower string (210) in order to fit inside. However, the diameter of the upper string (208) may be equal or slightly larger than the lower string (210).

In some embodiments, the surface casing (206) is a 9 and ⅝ inch casing pipe. The bell end (212) of the lower string (210) may have an 8.25 inch diameter, while the rest of the lower string (210) may have a 4.5 inch or 5.5 inch diameter. The upper string (208) may have a diameter of 4.5 inches or 5.5 inches depending on the diameter of the lower string (210).

Cement (214) (e.g., cement slurry (111)) may be pumped into an annulus (215) around the completion string and circulated to form a cement top (216) at a desired depth. In embodiments described herein, the cement top (216) forms at a depth downhole from the upper string (208) of the completion string (202). A completion shoe track (218) may be installed at a lower end of the lower string (210) to guide tools and fluids. A person of ordinary skill in the art may appreciate that the completion shoe track (218) may include cementing equipment, such as float shoe, float collar, and guide shoe. The completion shoe track (218) may guide the completion string (202) to land at total depth and prevent cement backflow when pumping.

Figures 4A, 4B:
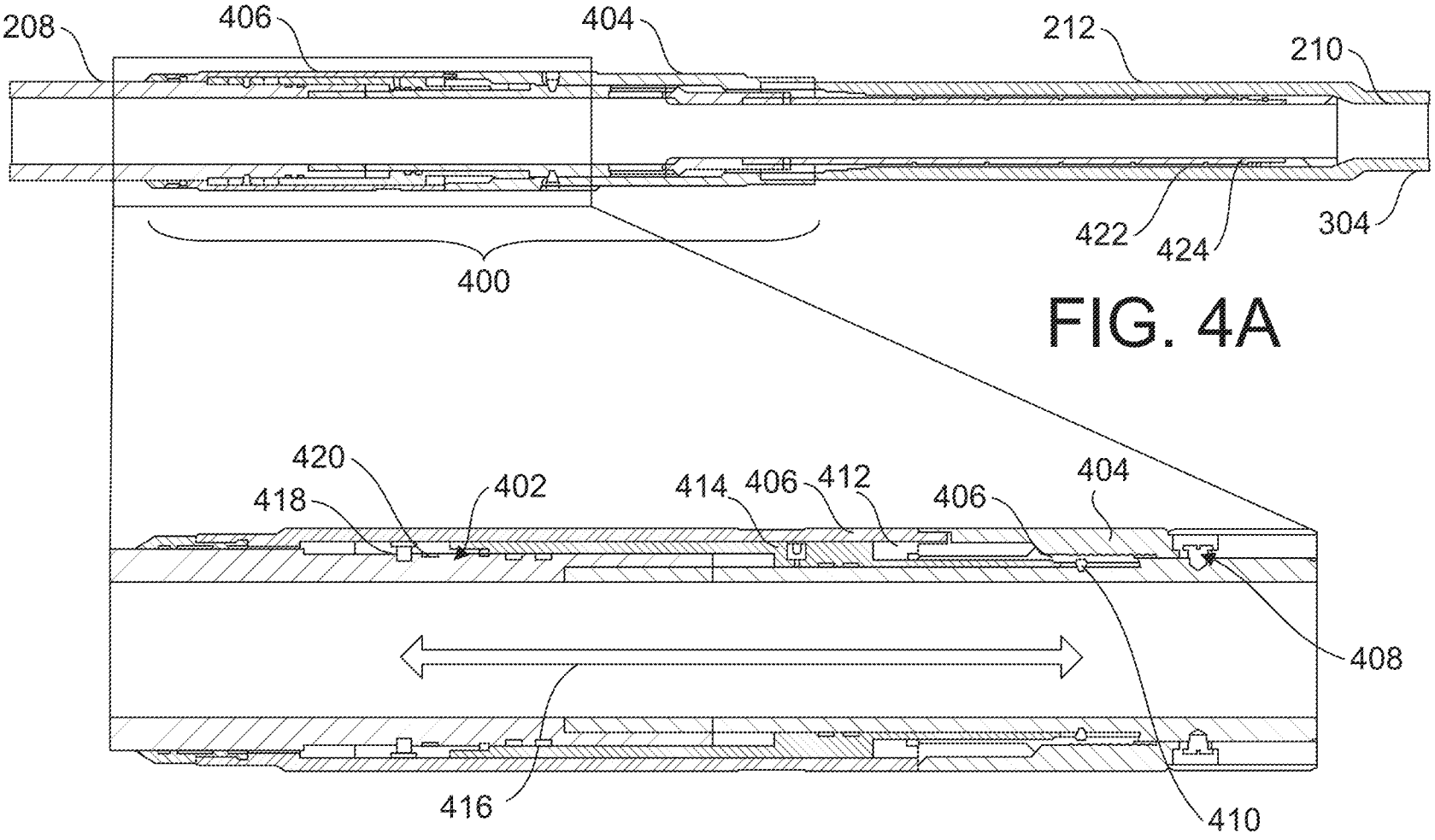
FIGS. 4A and 4B show a lateral view of a completion string used in conjunction with FIGS. 2 and 3 in accordance with one or more embodiments.

As further described in detail in FIGS. 4A and 4B, the completion string (202) includes a connecting and disconnecting feature of the upper string (208) to the lower string (210), such that the upper string (208) may be removed and replaced during workover.

Figure 3:
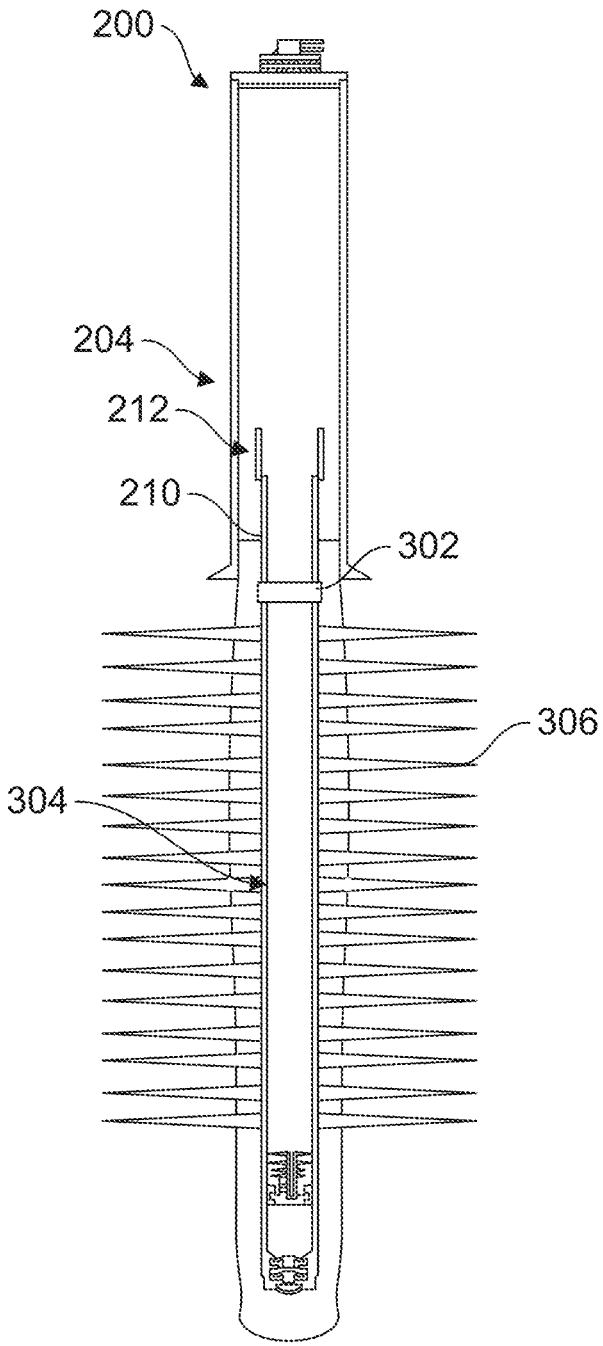
FIG. 3 shows a long string system used in conjunction with FIG. 2 in accordance with one or more embodiments.

FIG. 3 shows a long string system in accordance with one or more embodiments. Specifically, FIG. 3 shows the long string system (200) of FIG. 2 during workover. As illustrated, the upper string (208) of completion string (202) of FIG. 2 has been disconnected from the lower string (210) and removed from the bell end (212) and the wellbore (204). The upper and lower string (208,210) may be polished bore receptacles (PBR). The long string system (200) may be designed without elastomeric seals to avoid well integrity issues. An isolation barrier (302) or packer may be positioned in a non-bell end section of the lower string (210) below the cement top (216) to maintain pressure integrity and separate treated zones. Fracturing operations may be conducted through the completion string (202). A portion of the non-bell end (304) may be cemented into the wellbore (204). During fracturing operations, perforations (306) are created through the lower string (210) and cement (214) into a reservoir. The perforations (306) allow hydraulic fluid to stimulate a formation in the reservoir and provide production pathways for hydrocarbons. During workover, the upper string (208) is disconnected and removed. The cement (214) sheath, isolation barrier (302), and perforations (306) may maintain zonal integrity and controlled fluid communication with the reservoir.

FIGS. 4A and 4B show a lateral view of a completion string in accordance with one or more embodiments. Specifically, FIGS. 4A and 4B show the longitudinal view of internal components of the completion string (202) described in FIGS. 2 and 3. FIG. 4A shows the upper string (208) connected to the lower string (210) in the bell end (212) section. As illustrated, the upper string (208) is received within the bell end (212) of the lower string (210). The upper string (208) is not inserted into the non-bell end (304) of the lower string (210). The completion string (202) includes an anchor latch mechanism (400) and an annular release mechanism (402) for connecting and disconnecting the upper string (208) to/from the lower string (210). The anchor latch mechanism (400) includes a first latch portion (404) fixed to the lower string (210) and a second latch portion (406) fixed to the upper string (208). Insertion of the upper string (208) into the bell end (212) engages the second latch portion (406) with the first latch portion (404) to connect the lower string (210) to the upper string (208).

For example, the anchor latch mechanism (400) provides a mechanical connection between the upper string (208) and the lower string (210). Once the upper string (208) is received within the bell end (212), the second latch portion (406) aligns and engages with the first latch portion (404). Latch profiles of the first and second latch portion (404,406) may interlock through keys, dogs, or collet fingers, which expand or snap into place to form a secure connection. Once latched and connected, the anchor latch mechanism (400) anchors the upper string (208) to the lower string (210), transferring axial loads and pressure containment across the connection. In some embodiments, the anchor latch mechanism (400) includes a snap-in and shear-out latch mechanism. A force shear pin (408) may retain the first latch portion (404) to the lower string (210).

As shown in the close-up view of FIG. 4B, a shear pin (410) is pinned in the anchor latch mechanism (400) to retain the anchor latch mechanism in an engaged position. The shear pin (410) is breakable upon application of a predetermined axial force. For example, a load of 100,000 to 150,000 pounds of force may be used to break the shear pin (410). The predetermined axial force may be rotation of the upper string (208). For example, rotation of the upper string (208) may release the anchor latch mechanism (400). For example, the shear pin (410) holds the connection of the first latch portion (404) and the second latch portion (406) in place to prevent unintentional release during normal operations, such as hydraulic fracturing or producing hydrocarbons.

As discussed previously, fluid may flow through the completion string (202) through an annulus (i.e., annulus (215)) of the upper string (208) and the lower string (210). The annular release mechanism (402) is located in the upper string (208) and includes an atmospheric chamber (412) and a piston sleeve (414). The atmospheric chamber (412) is disposed radially within the upper string (208). The annular release mechanism (402) may be isolated from the flow path (416). The piston sleeve (414) defines at least a portion of the atmospheric chamber (412). The piston sleeve (414) is axially shiftable. A shearable connection (418), such as a shear pin or screw, retains the piston sleeve (414). The shearable connection (418) may be broken or sheared upon application of annular pressure, such that the piston sleeve (414) axially shifts to disengage the anchor latch mechanism (400). Tension may be required to shear a series of shearable connections (418). The shearable connection (418) may create a safety mechanism in case the anchor latch mechanism (400) releases too early. Annular pressure may be communicated through the annulus (215) by applying pressure on surface. In such instances, the annulus (215) may be a closed system, such that when fluid, such as water, is pumped into the annulus (215), pressure builds up. The annular pressure may then be applied externally on the exposed diameter of the completion string (202) to communicate directly against the atmospheric chamber (412). For example, the annular pressure may create a downward or downhole force on the external area of the upper string (208). A downward force created by the annular pressure in the annulus (215) may be transmitted to air inside the atmospheric chamber (412). The annular pressure on the atmospheric chamber (412) may force the piston sleeve (414) to axially move upward or uphole. When enough force is applied beyond the rating of the shearable connection (418), the shearable connection (418) may break and the piston sleeve (414) axially moves upward.

The annular release mechanism (402) may include elastomeric seals that are isolated from the flow path (416) of the stimulation or produced fluids inside a tubing diameter. In one or more embodiments, a seal stack (422) is lined within a portion of upper string (208) that is inserted into the bell end (212) of the lower string (210). In some embodiments, four seal stacks (422) are lined within the upper string (208). A protective barrier (424) may overly the seal stack (422) to isolate the seal stack (422) from fluids in a flow path (416) within the upper string (208). The protective barrier (424) may be a debris protective layer and/or a scraper protective layer. The seal stack (422) may be high-pressure seals isolated from the flow path (416).

Figure 5A:
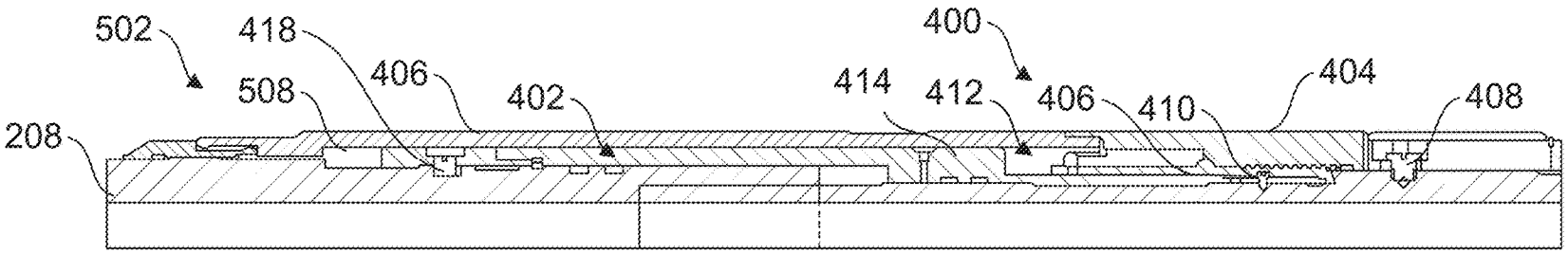
FIG. 5 shows a partial lateral view of a completion string used in conjunction with FIGS. 2-4 in accordance with one or more embodiments.
Figure 5B:
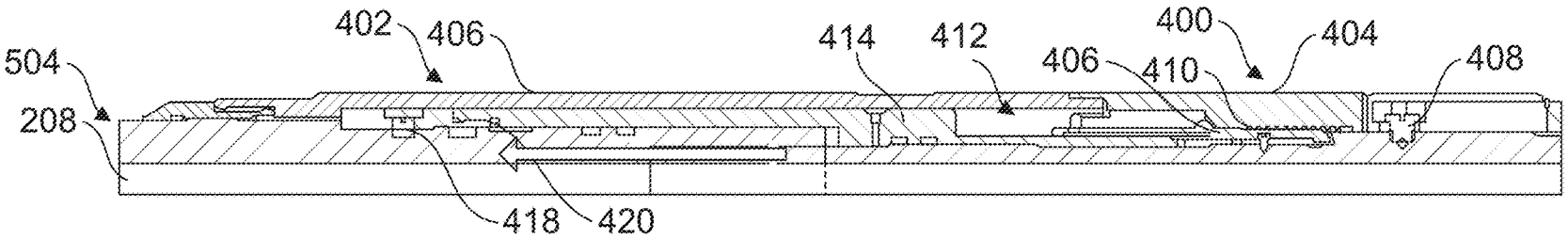
Figure 5C:
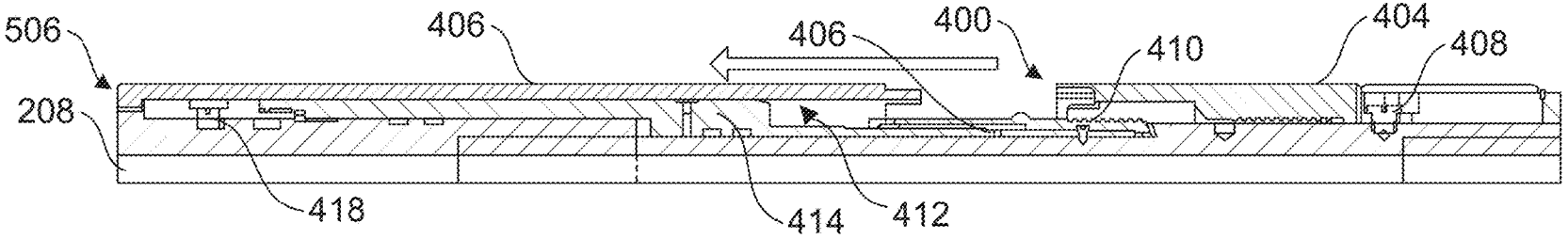

FIG. 5 shows a partial lateral view of a completion string in accordance with one or more embodiments. Specifically, FIG. 5 shows close-up views of the annular release mechanism (402) and anchor latch mechanism (400) of the completion string (202) of FIGS. 2-4 in different positions. As illustrated, FIG. 5 shows a close-up view of the completion string (202) in an engaged position (502) run-in-hole, a disengaged position (504), and a released position (506).

As illustrated, in the engaged position (502), the second latch portion (406) is engaged with the first latch portion (404) of the anchor latch mechanism (400) to secure the upper string to the lower string (shown in previous embodiments). The shear pin (410) retains the second latch portion (406) with the first latch portion (404). In the engaged position, the piston sleeve (414) is held in an initial position by a shearable connection (418) and the atmospheric chamber (412), preventing the piston sleeve (414) from shifting. The first and second latch portions (404,406) remain fully engaged. An internal cavity (508) in the upper string (208) is positioned adjacent the second latch portion (406) region, but remains unoccupied while the piston sleeve (414) is retained in the engaged position (502).

As illustrated, in the disengaged position (504), the annular release mechanism (402) is actuated. For example, the annular release mechanism (402) communicates annular pressure externally to the atmospheric chamber (412) causing a downward force on the piston sleeve (414) and the shearable connection (418). When sufficient annular pressure is applied on the atmospheric chamber (412), the piston sleeve (414) shifts to a direction shown by an arrow to shear the shearable connection (418) and enter the internal cavity (508). As the piston sleeve (414) translates or axially shifts, an upper portion of the sheared shearable connection (418) (e.g., the piston sleeve (414)) enters the cavity (508) formed in the upper string (208). This movement provides the clearance required for the second latch portion (406) to move inward, thereby disengaging from the first latch portion (404).

As illustrated, in a released position (506), the second latch portion (406) is completely released from the first latch portion (404) in order to remove and retrieve the upper string (208). The completion string (202) may be released into the released position (506) after the disengaged position (504). For example, an axial force, such as a rotation or straight-pull, applied upon the upper string (208) shears the shear pin (410). Once sheared, the second latch portion (406) is released from the first latch portion (404). Once the completion string (202) has been in the disengaged position (504) and the released position (506), the upper string (208) along with the second latch portion (406) may be pulled and withdrawn from the lower string (210) and out of the wellbore (204).

In one or more embodiments, a workover stage is performed on a long string system (200), described in FIGS. 2 and 3. In order to apply the operational sequence of activating the annular release mechanism (402) and releasing the anchor latch mechanism (400), described in FIG. 5, to the long string system (200), an exemplary method is performed. For example, the method begins by preparing a well and nipple up a blowout preventor (BOP) as per standard procedures known in the art after isolating any pressure or flow by pushing existing fluids in the wellbore back into formation or by installing isolation plugs. A hanger is released and straight pulled to pull upper completion. In one or more embodiments, 150,000 pounds force or less may be required to shear the shear pin (410). A wellbore cleanout (WBCO) may then proceed to replace existing fluid in the wellbore with clean fluid that has a mud weight that creates a hydrostatic column that withstands formation pore pressure. Before running the WBCO, analysis wireline logs may be used to determine the condition of existing casing strings. Remedial work may be performed to fix casing strings, if required, such as casing patching, prior to performing WBCO. The upper string (208) of the completion string (202) may be picked up and snapped into the lower string (210) using the anchor latch mechanism (400) in the engaged position (502). Space out may be prepared once engaged. The completion string (202) may be rotated to release the completion string (202). The hanger may be picked up and pup joints may be spaced out. The completion string (202) and hanger may land and be confirmed with overpull. A pressure test may be conducted on the tubing casing annulus.

Figures 6A, 6B:
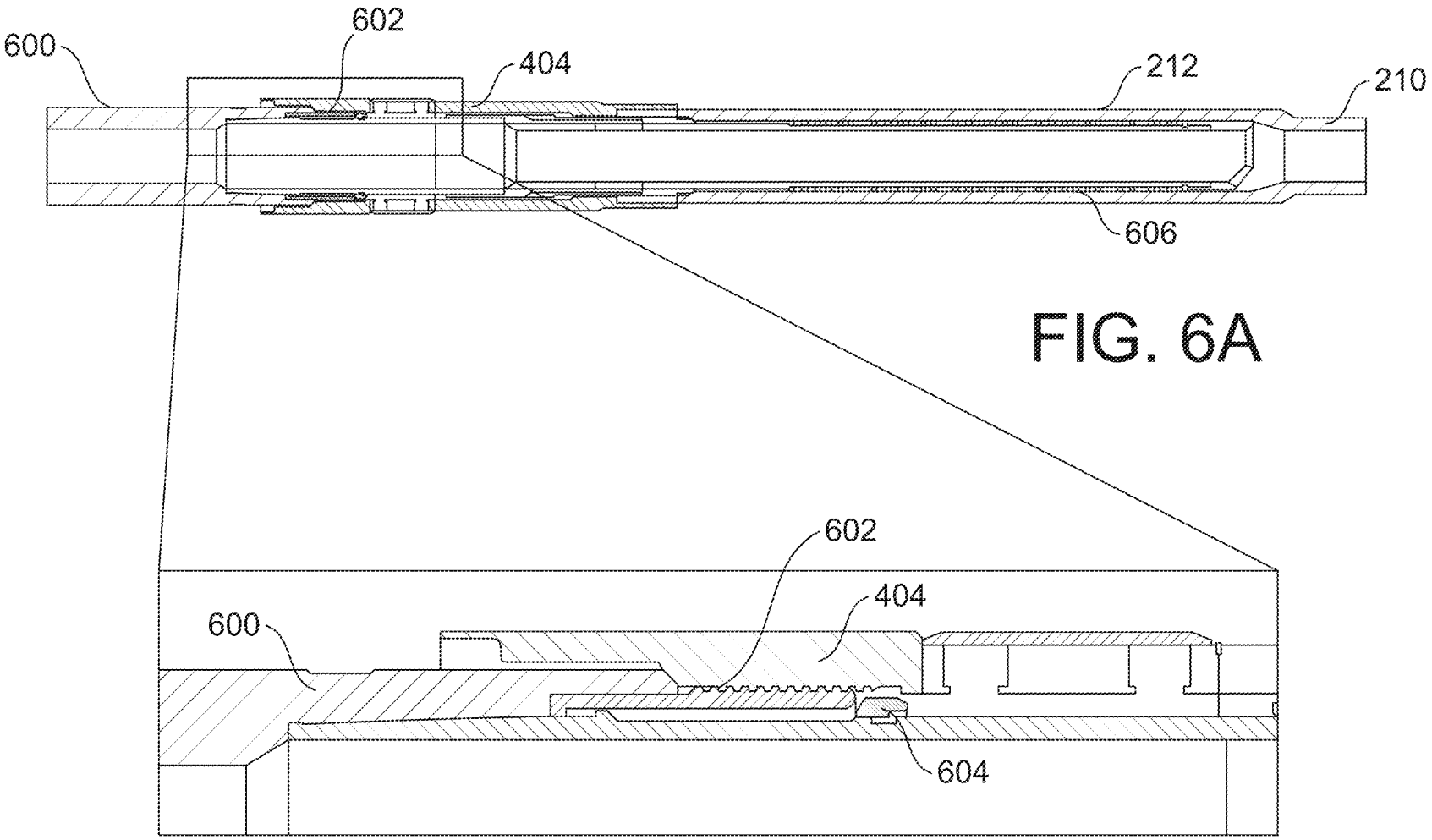
FIGS. 6A and 6B show a lateral close-up view of a completion string used in conjunction with FIGS. 2-5 in accordance with one or more embodiments.

FIGS. 6A and 6B show a lateral close-up view of a completion string in accordance with one or more embodiments. Specifically, FIGS. 6A and 6B show a close-up view of the completion string (202) of FIGS. 2-5 after removal and replacement of the upper string (208) reconnecting a new upper casing string (600). For example, the completion string (202) of FIGS. 4A and 4B undergoes a workover to disengage and release the upper string (208) (as described in FIG. 5) to run a new upper casing string (600) into the lower string (210). As illustrated in FIG. 6A, in place of the upper string (208), the new upper casing string (600) is received within the bell end (212) of the lower string (210). The new upper casing string (600) may include new seal stacks (606) which are anchored inside the bell end (212) of the original lower string (210) that remained in the wellbore (204).

In FIG. 6B, a new anchor latch portion (602) that engages with the original first latch portion (404) of the lower string (210). In such instances, the new anchor latch portion (602) may be a 6.000×4.740 anchor latch. In some embodiments, the new anchor latch portion (602) is retained by new shearable connection (604) breakable and released by a pull or rotational force. The new shearable connection (604) may require a 100,000-150,000 pounds force pull or rotation to release the new shearable connection (604). Once released, the new upper casing string (600) may be removed from the lower string (210) and pulled from the wellbore (204). To reconnect the completion string (202) by connecting the new upper casing string (600) to the lower string (210), the new upper casing string (600) may have an anchor latch system run to engage with existing seals of the original long string system (200). The anchor latch system may be a snap-in/shear-out latch mechanism.

In some embodiments, a completion high pressure rating of 15,000 pounds per square inch is maintained. Therefore, there is no need to lower the pressure rating of re-connecting new upper completion (i.e., new upper casing string (600)) due to limitations in downhole equipment to re-connect to the existing cemented part of the longstring completion (i.e., lower string (210)).

Figure 7:
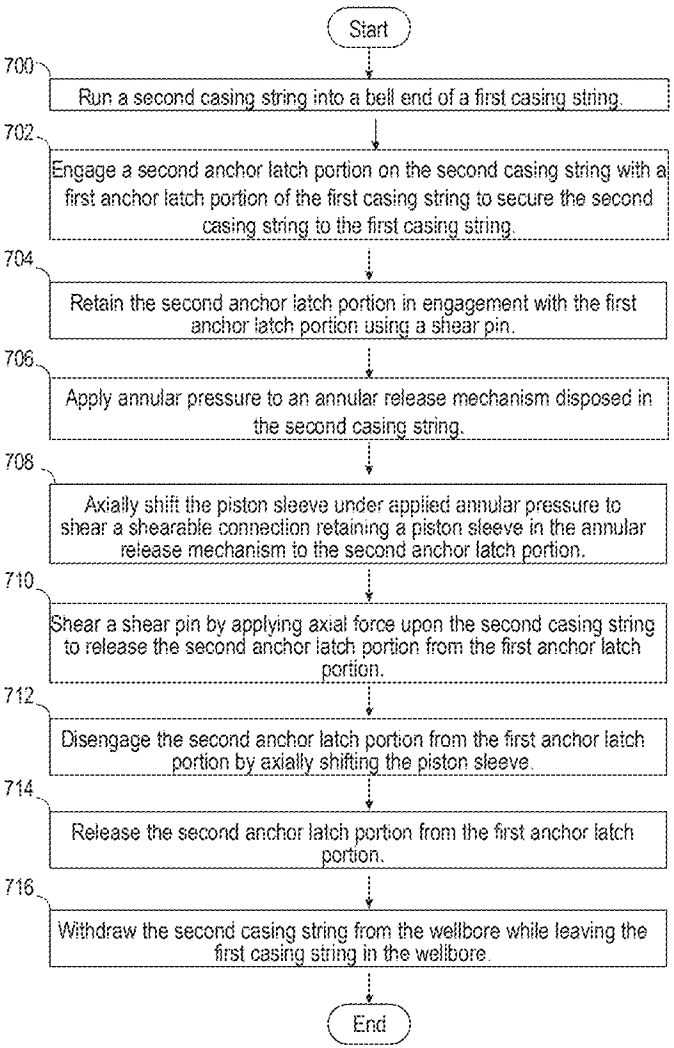
FIG. 7 shows a flowchart in accordance with one or more embodiments.

FIG. 7 shows a flowchart in accordance with one or more embodiments. Specifically, FIG. 7 describes a general method for disconnecting a first casing string (i.e., upper string (208)) and a second casing string (i.e., lower string (210)) in a wellbore. One or more blocks in FIG. 7 may be performed by one or more components (e.g., completion string (202)) as described in FIGS. 1-6. While various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 700, the second casing string is run into a bell end of the first casing string. In Block 702, a second anchor latch portion on the second casing string is engaged with a first anchor latch portion of the first casing string to secure the second casing string to the first casing string. In Block 704, the second anchor latch portion in engagement with the first anchor latch portion is retained using a shear pin. The first anchor latch portion and the first casing string may be retained using a force shear pin.

In some embodiments, a portion of the second casing string ran into the bell end is lined with a seal stack. The seal stack may be isolated from fluids in a flow path within the second casing string, via a protective barrier overlying the seal stack. The protective barrier may include a debris protective layer and a scraper protective layer. At least a portion of a non-bell end of the first casing string may be cemented to the wellbore. Fluid flow may be isolated within the first casing string using an isolation barrier disposed in the non-bell end.

In Block 706, annular pressure is applied to an annular release mechanism disposed in the second casing string. The annular release mechanism may include a piston sleeve and an atmospheric chamber. The annular pressure is communicated through a pressure port to act on the piston sleeve against the atmospheric chamber. The annular pressure applied may be 7,800 pounds per square inch. In Block 708, the piston sleeve is axially shifted under applied annular pressure to shear a shearable connection retaining the piston sleeve to the second anchor latch portion is sheared.

In Block 710, the shear pin is sheared by applying axial force upon the second casing string to release the second anchor latch portion from the first anchor latch portion. The shear pin may be sheared by rotating the second casing string in a right-hand motion. The axial force applied may be a release force greater than 100,000 pound force. In Block 712, the second anchor latch portion is disengaged from the first anchor latch portion by axially shifting the piston sleeve. Upon shearing of the shear pin, in Block 714, the second anchor latch portion is released from the first anchor latch portion. A collet of the second anchor latch portion may be released. Upon disengagement and releasing of the second anchor latch portion from the first anchor latch portion, in Block 716, the second casing string is withdrawn from the wellbore while leaving the first casing string in the wellbore.

Upon withdrawing of the second casing string, a new casing string may be run into the bell end of the first casing string. A new anchor latch portion on the new casing string may engage with the first anchor latch portion.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A completion string for a wellbore comprising:

a first casing string comprising a bell end;

a second casing string configured to be received within the bell end of the first casing string;

an anchor latch mechanism comprising a first latch portion fixed to the first casing string and a second latch portion fixed to the second casing string, wherein insertion of the second casing string into the bell end engages the second latch portion with the first latch portion to connect the first casing string to the second casing string;

a shear pin pinned in the anchor latch mechanism that retains the anchor latch mechanism in an engaged position, wherein the shear pin is breakable upon application of a predetermined axial force; and an annular release mechanism disposed in the second casing string comprising an atmospheric chamber disposed radially within the second casing string and a piston sleeve defining at least a portion of the atmospheric chamber, wherein the piston sleeve is axially shiftable upon application of external annular pressure against the atmospheric chamber shearing a shearable connection, such that the piston sleeve axially shifts to disengage the anchor latch mechanism.

2. The completion string of claim 1, further comprising:

a seal stack lined within a portion of the second casing string inserted into the bell end; and a protective barrier overlying the seal stack for isolating the seal stack from fluids in a flow path within the second casing string, wherein the protective barrier comprises a debris protective layer and a scraper protective layer.

3. The completion string of claim 1, wherein the anchor latch mechanism is releasable by rotation of the second casing string.

4. The completion string of claim 1, wherein the anchor latch mechanism comprises a snap-in and shear-out latch mechanism.

5. The completion string of claim 1, further comprising:

an isolation barrier disposed in a non-bell end of the first casing string, wherein at least a portion of the non-bell end is cemented into the wellbore.

6. The completion string of claim 1, wherein the first casing string and the second casing string comprise a polished bore receptacle (PBR).

7. The completion string of claim 1, further comprising:

a force shear pin retaining the first latch portion and the first casing string.

8. A method for disconnecting a first casing string from a second casing string in a wellbore, the method comprising:

running the second casing string into a bell end of the first casing string;

engaging a second anchor latch portion on the second casing string with a first anchor latch portion of the first casing string to secure the second casing string to the first casing string;

retaining the second anchor latch portion in engagement with the first anchor latch portion using a shear pin;

applying annular pressure to an annular release mechanism disposed in the second casing string, the annular release mechanism comprising a piston sleeve and an atmospheric chamber, wherein the annular pressure is communicated externally to act on the piston sleeve against the atmospheric chamber;

axially shifting the piston sleeve under applied annular pressure to shear a shearable connection retaining the piston sleeve to the second anchor latch portion;

shearing the shear pin by applying axial force upon the second casing string to release the second anchor latch portion from the first anchor latch portion;

disengaging the second anchor latch portion from the first anchor latch portion by axially shifting the piston sleeve;

upon shearing the shear pin, releasing the second anchor latch portion from the first anchor latch portion; and upon disengagement and releasing of the second anchor latch portion from the first anchor latch portion, withdrawing the second casing string from the wellbore while leaving the first casing string in the wellbore.

9. The method of claim 8, further comprising:

upon withdrawing of the second casing string, running a new casing string into the bell end of the first casing string; and engaging a new anchor latch portion on the new casing string with the first anchor latch portion.

10. The method of claim 8, further comprising:

lining a portion of the second casing string ran into the bell end with a seal stack; and isolating the seal stack from fluids in a flow path within the second casing string, via a protective barrier overlying the seal stack, wherein the protective barrier comprises a debris protective layer and a scraper protective layer.

11. The method of claim 8, wherein releasing the second anchor latch portion comprises releasing a collet of the second anchor latch portion.

12. The method of claim 8, wherein shearing the shear pin comprises rotating the second casing string in a right-hand motion.

13. The method of claim 8, further comprising:

cementing at least a portion of a non-bell end of the first casing string to the wellbore; and isolating fluid flow within the first casing string using an isolation barrier disposed in the non-bell end.

14. The method of claim 8, retaining the first anchor latch portion and the first casing string using a force shear pin.

15. The method of claim 8, wherein applying annular pressure comprises applying up to 7,800 pounds per square inch, and wherein applying axial force comprises applying a release force greater than 100,000 pound force.

* * * * *